United States Patent [19]

Keske

[11] 4,196,547

[45] Apr. 8, 1980

[54] CYLINDER LINER HONING

[75] Inventor: Frank E. Keske, Chillicothe, Ill.

[73] Assignee: Caterpillar Tractor Co., Peoria, Ill.

[21] Appl. No.: 879,844

[22] Filed: Feb. 22, 1978

[51] Int. Cl.[2] ..... B24B 33/00

[52] U.S. Cl. ..... 51/204; 51/206.4; 51/290; 51/330

[58] Field of Search ..... 51/34 R, 181 R, 204, 51/206 R, 206.4, 290, 326, 327, 328, 330, 338–354, 58

[56] References Cited

U.S. PATENT DOCUMENTS

| | | | |
|---|---|---|---|
| 1,715,255 | 5/1929 | Strand et al. | 51/339 |
| 1,864,616 | 6/1932 | Rayner | 51/204 X |
| 2,404,192 | 7/1946 | Ries et al. | 51/204 |
| 2,496,352 | 2/1950 | Metzger et al. | 51/181 X |
| 3,537,216 | 11/1970 | Borgh | 51/327 |
| 3,678,630 | 7/1972 | Borcherding | 51/58 |

FOREIGN PATENT DOCUMENTS

| | | | |
|---|---|---|---|
| 596318 | 1/1948 | United Kingdom | 51/184.1 |

*Primary Examiner*—Harold D. Whitehead
*Assistant Examiner*—Robert P. Olszewski
*Attorney, Agent, or Firm*—Phillips, Moore, Weissenberger, Lempio & Majestic

[57] ABSTRACT

It is desirable to provide a relatively coarse finish at one end of an inner cylindrical wall of a cylinder or a cylinder liner and a relatively finer finish towards another end of said inner cylinder wall. A honing member is provided for rotation and oscillation in contact with the inner cylinder walls. A first section of the honing member has a relatively coarse grit surface and a second section of the honing member has a relatively fine grit surface. The abovementioned oscillation and rotation of such a honing member comprises an improved method for honing a cylindrical wall.

5 Claims, 5 Drawing Figures

CYLINDER LINER HONING

BACKGROUND OF THE INVENTION

1. Field of the Invention

The invention relate to the honing of the inner cylindrical wall of engine cylinders or cylinder liners. More particularly the invention relates to providing a surface on an inner cylinder wall which has graduated roughness with one end of the inner cylindrical wall being relatively rough and another end thereof being relatively fine and with intermediate sections blending the relatively rough and relatively fine sections into one another.

2. Prior Art

If the honing of an inner cylindrical wall of a cylinder or cylinder liner leads to a coarse surface then more oil remains in the scratches in the wall after the piston rings pass a particular point on the inner cylindrical wall than if the wall is fine honed. Combustion processes burn off at least part of the trapped oil during the expansion stroke of the piston. The more oil that remains in the scratches, the more oil there is to burn. Coarse honing in the upper end of an inner cylindrical wall smoothes brake-in of the engine considerably. A combination of coarse and fine honed surfaces on an inner cylindrical wall could be obtained by using two separate honing operations. However, the use of two operations would present a problem in that where the two hones came together there would be a sharp step or change in quality of the honing of the wall. Also, it would be difficult to assure that each of the two honed sections of the inner cylindrical wall, i.e., the fine honed section and the coarse honed section, would be relatively exactly annular. This could lead to one side of of the piston seeing a coarse surface while the opposite side of the piston which was at the same axial position relative thereto would see a fine surface. It is also possible to chemically produce inner cylindrical walls having a rough surface towards a first end thereof and a relatively fine surface towards a second end thereof. However, even in such a situation the boundary between the relatively rough surface and the relatively fine surface tends to be rather abrupt. This abruptness can lead to somewhat of an undesirable abruptness of action of the piston as it reciprocates within the inner cylindrical wall.

SUMMARY OF THE INVENTION

The present invention is directed to overcoming one or more of the problems as set forth above.

According to the present invention, there is provided a hone (or honing tool) for an inner cylindrical wall of a cylinder or cylinder liner for obtaining hones of controlled and different finish roughness along the length of the inner cylindrical wall. The honing tool comprises a honing member having a first section extending from a first end thereof towards a second end thereof and a second section extending from said first section to said second end of said housing member. Said first section comprises a relatively coarse grit surface and said second section comprises a relatively fine grit surface said first and second sections meeting in an oblique line.

In another sense the invention relates to a method of providing a finish comprising a plurality of generally discreet annular sections of varying roughness on an inner cylindrical wall of a cylinder liner. The method comprises contacting a honing member with the inner cylindrical wall with the member being aligned parallel to the axis of the cylindrical wall, the member having a plurality, generally two, of sections with a first of said sections beginning at a first end of said member and successive of said sections proceeding in order towards a second end of said member, said first section having relatively coarse grit surface and successive of said sections having relatively finer grit surfaces in order towards said second end of said member, said member having a length of less than the length of said inner cylindrical wall, said second end of said member extending axially within a cylindrical cavity formed by said cylindrical wall. The member is moved circularly while in contact with said inner cylindrical wall and simultaneously is oscillated axially relative to said inner cylindrical wall.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENTS

Figure 1:
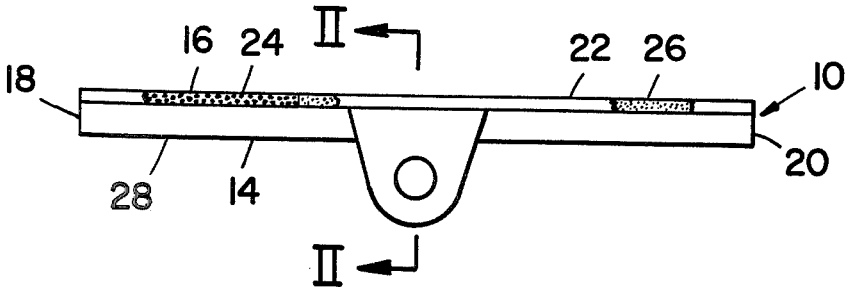
FIG. 1 illustrates in side view a hone in accordance with the present invention.
Figure 5:
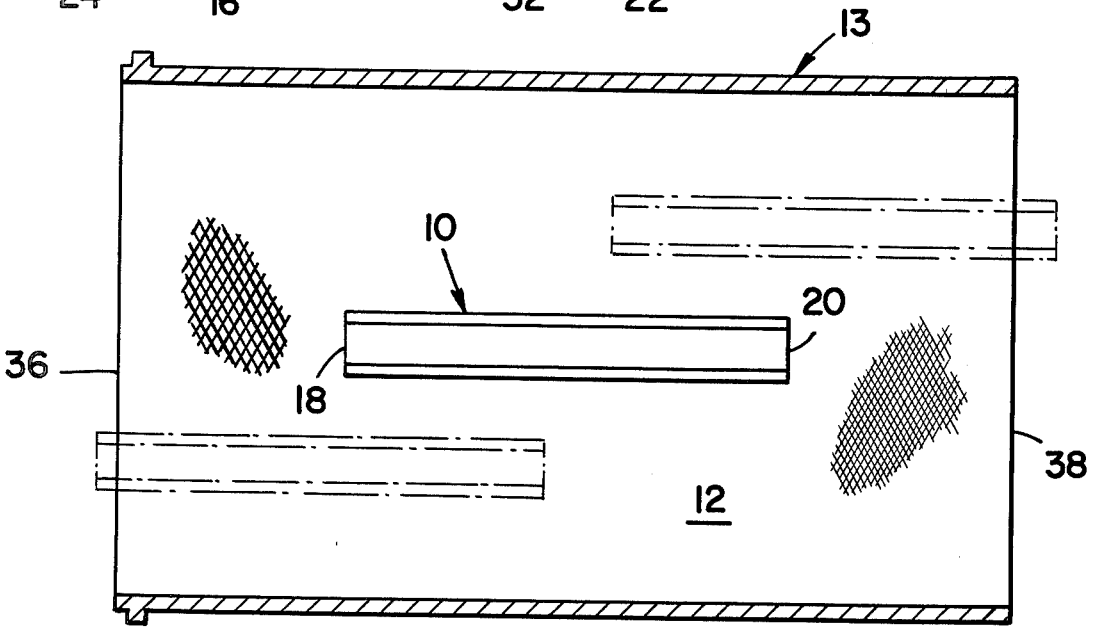
FIG. 5 illustrates in side partial section view a hone and an inner cylindrical wall with the hone in its several positions of oscillation.
Figure 4:
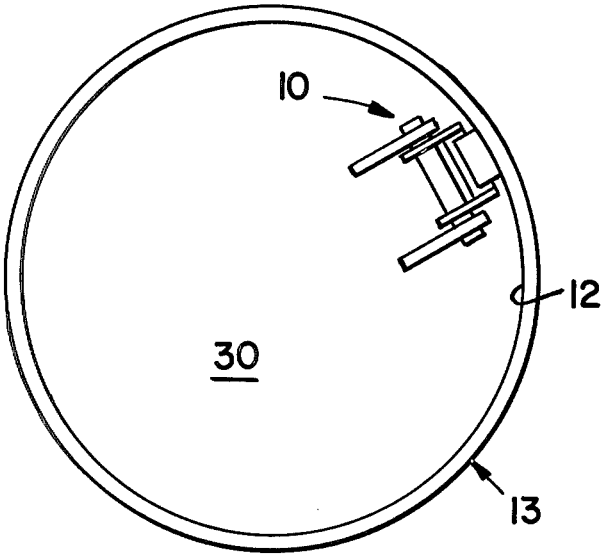
FIG. 4 illustrates in top view a hone in contact with an inner cylindrical wall during honing.

Adverting to FIG. 1 there is illustrated therein a hone 10 for use in honing an inner cylindrical wall 12 (see FIGS. 4 and 5) of a cylinder or a cylinder liner 13. By use of the particular hone 10 of the present invention there are obtained hones of controlled and different finished roughness along the length of the inner cylindrical wall. The hone 10 comprises a longitudinally extending honing member 14. The member 14 has a first section 16 extending from a first end 18 thereof towards a second end 20 thereof and a second section 22 extending from the first section 16 to the second end 20 of the member 14. The first section 16 comprises a relatively coarse grit surface 24 and the second section 22 comprises a relatively fine grit surface 26. It will be noted that the entire member 14 is generally supported upon a metallic undermember 28. The honing member 14 can be made in any of a number of ways. For example, a separate coarse grit surface 24 and fine grit surface 26 can be formulated and then these can each be glued or otherwise sealed in place to the metallic undermember 28. Alternatively, in a single moulding operation both the coarse grit surface 24 and the fine grit surface 26 can be moulded on to the metallic undermember 28. As yet another alternative a pair of partial metallic undermembers can be formulated, one with the relatively coarse grit surface 24 thereon and the other with the relatively fine grit surface 26 thereon and then the two partial metallic undermembers can be fastened together mechanically as by welding, clamping, bolting or the like to form the overall metallic undermember 28.

The first section 16 of the honing member 14 will preferably extend about one-third the length of the overall member 14. Accordingly, the second section 22 will generally extend about the remaining two-thirds of the length of the member 14. It is preferred that the coarse grit surface 24 be selected to provide about a 20 to 30 microinch finish on the inner cylindrical wall 14 and that the fine grit surface 26 be selected to provide about a 5 to 15 microinch finish on the inner cylindrical wall 12. These finishes will provide generally optimal operation for a piston-cylinder arrangement.

Alternate Embodiment

Figure 2:
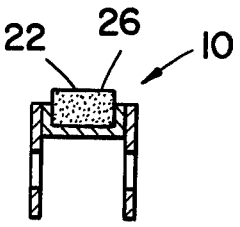
FIG. 2 illustrates a view taken along the line II—II of FIG. 1.
Figure 3:
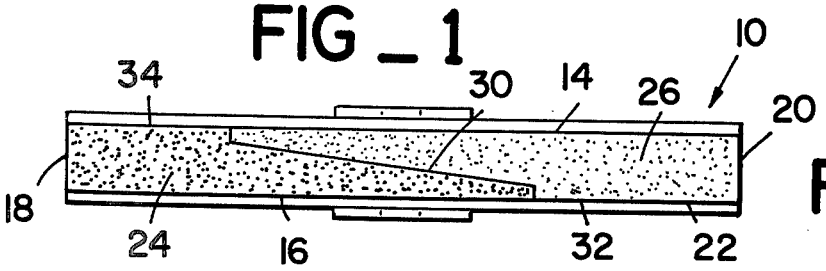
FIG. 3 illustrates in top view an alternate hone in accordance with the present invention.

In the alternate embodiment as shown in FIG. 3, the first section 16 and second section 22 meet in an oblique line 30. The second section 22 preferably extends from the second end 20 of the member 14 along a leg 32 a greater distance than the first section 16 extends from the first end 18 of the member 14 along a leg 34. The coarse and fine grit surfaces 24 and 26 are generally selected as with the embodiment of FIGS. 1 and 2.

Method

In accordance with the method of the present invention there is provided a finish comprising a plurality of generally discreet annular sections of discreet and different roughness on the inner cylindrical wall 12 of a cylinder or a cylinder liner. Basically, a honing member 14 as just described above with respect to the two alternate embodiments of the invention is utilized as a hone. The honing member 14 may, if desired, have more than two sections with successive sections having successively changing coarseness of grit therein from a most coarse section at a first end 18 of the honing member 14 to a finest grit section at the second end 20 of the member 14. In any event, the aforementioned honing member is contacted with the inner cylindrical wall with the longitudinal extension of the member 14 being parallel to the axis of the cylindrical wall 12. The member 14 is restricted to having a length of less than that of the inner cylindrical wall 12. The second end 20 of the member 14 extends axially within a cylindrical cavity 30 formed by the inner cylindrical wall 12.

The member 14 is moved circularly, either in one direction or back and forth, relative to the axis of the cylinder while being maintained in contact with the cylindrical wall 12. Simultaneously to the circular movement and the contacting, the member 14 is oscillated axially relative to the inner cylindrical wall 12. The member 14 is generally oscillated so that its ends 18 and 20 oscillate to protrude slightly out of the respective corresponding ends 36 and 38 of the cylindrical wall 12 whereby the first end 36 of the inner cylindrical wall 12 is ground primarily by the relatively coarse grit surface 24 and the second end 38 of the inner cylindrical wall 12 is ground primarily by the relatively fine grit surface 26. Because of the combined circular movement and oscillation of the member 14, the inner wall 12 is generally scored with a criss-cross pattern. It will be clear that intermediate the two ends 36 and 38 of the inner cylindrical wall 12, portions of the inner cylindrical wall 12 are alternately contacted with the relatively coarse grit surface 24 and the relatively fine grit surface 26 to provide an overall smooth gradation in roughness along the length of the cylinder wall 12.

It is preferred that the length of the member 14 be only about one-half the length of the inner cylindrical wall 12. It is further preferred with respect to the embodiment of FIGS. 1 and 2 that the first (coarse) section 16 of the member 14 extends about one-third the length of said member 14 and that the second (fine) section 22 of the member 14 extends about the remaining two-thirds of the length of said member 14. In this manner, as the member 14 is oscillated from one end to the other of the cylindrical cavity 30 there is provided a relatively coarse finish on about one-sixth of the inner cylindrical wall (from the first end 32 thereof to about one-sixth down the length thereof), a progressively relatively finer finish on the next intermediate one-half of said inner cylindrical wall 12 (from about one-sixth of the distance from the first end 32 of the inner cylindrical wall 12 to the second end 34 of the inner cylindrical wall 12 and about two-thirds of said distance), and a relatively fine finish the final one-third of said inner cylindrical wall. It is further clear that intermediate the first end 32 of the inner cylindrical wall 12 and the second end 34 thereof, the coarse and fine finishes formed on the inner cylindrical wall 12 will relatively smoothly blend into one another.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. A hone for an inner cylindrical wall of a cylinder or cylinder liner for obtaining hones of controlled and different finish roughness along the length of said wall, comprising:

a honing member having a first section extending from a first end thereof towards a second end thereof and a second section extending from said first section to said second end of said member, said first section comprising a relatively coarse grit surface and said second section comprising a relatively fine grit surface, said first and second sections meeting in an oblique line.

2. A hone as in claim 1 wherein said second section extends from said second end of said member a greater distance than said first section extends from said first end of said member.

3. A method of providing a finish of graded smoothly varying roughness from one end to another of an inner cylindrical wall of a cylinder or a cylinder liner, comprising:

contacting a honing member having a longitudinal extension parallel to the axis of said cylindrical wall with said cylindrical wall, said member having a plurality of sections with a first of said sections beginning at a first end of said member and successive of said sections proceeding in order towards a second end of said member, said first section having a relatively coarse grit surface and successive of said sections having relatively finer grit surfaces in order towards said second end of said member, said member having a length of less than said cylindrical wall, said second end of said member extending axially within a cylindrical cavity formed by said cylindrical wall;

moving said member circularly relative to said cylindrical axis while maintaining said honing member contacting with said cylinder wall; and simultaneously with said circular moving and contacting, oscillating said member axially relative to said cylindrical wall.

4. A method as in claim 3, wherein said first section extends about $\frac{1}{3}$ the length of said member, said second section extends about the remaining $\frac{2}{3}$ the length of said member and said oscillating comprises oscillating said member from one end to the other of said cylindrical cavity to provide a relatively coarse finish on about 1/6 of said cylindrical wall, a progressively relatively finer finish on an intermediate about $\frac{1}{2}$ of said cylinder wall, and a relatively fine finish on the remaining about $\frac{1}{3}$ of said cylinder wall with said coarse and fine finishes blending into one another via said intermediate about $\frac{1}{2}$ of said cylinder wall.

5. A method as in claim 4, wherein said coarse grit surface is selected to provide about a 20 to 30 microinch finish and said fine grit surface is selected to provide about a 5 to 15 microinch finish.

* * * * *